US011981486B2

(12) United States Patent
Margaritis

(10) Patent No.: US 11,981,486 B2
(45) Date of Patent: May 14, 2024

(54) GIFT WRAP SYSTEM

(71) Applicant: Ashlie Margaritis, Sumner, WA (US)

(72) Inventor: Ashlie Margaritis, Sumner, WA (US)

( * ) Notice: Subject to any disclaimer, the term of this patent is extended or adjusted under 35 U.S.C. 154(b) by 501 days.

(21) Appl. No.: 17/081,101

(22) Filed: Oct. 27, 2020

(65) Prior Publication Data

US 2021/0130054 A1 May 6, 2021

Related U.S. Application Data

(60) Provisional application No. 62/930,117, filed on Nov. 4, 2019.

(51) Int. Cl.
*B65D 65/22* (2006.01)
*B65D 65/10* (2006.01)

(52) U.S. Cl.
CPC ..... *B65D 65/22* (2013.01); *B65D 65/10* (2013.01); *B65D 2203/00* (2013.01); *B65D 2275/00* (2013.01); *B65D 2565/385* (2013.01)

(58) Field of Classification Search
CPC .... B65D 65/10; B65D 65/22; B65D 2203/00; B65D 2275/00; B65D 2565/385
USPC ..... 229/87.01
See application file for complete search history.

(56) References Cited

U.S. PATENT DOCUMENTS 5,004,144 A * 4/1991 Selga ..... A45C 7/0095 206/521
5,245,815 A * 9/1993 Savage ..... B65B 5/024 53/449
5,407,125 A * 4/1995 Yates ..... B65D 65/14 229/923
5,529,395 A * 6/1996 French ..... B65D 65/08 383/118
5,743,458 A 4/1998 French
5,979,744 A * 11/1999 Brigleb ..... B65D 67/00 229/87.01
7,077,308 B2 * 7/2006 Beach ..... B65D 67/00 383/66
7,926,702 B2 * 4/2011 Childs ..... B65D 29/00 383/105
8,931,242 B1 * 1/2015 Sardo ..... B65B 51/04 383/71
9,365,337 B2 * 6/2016 Fullan ..... B65D 65/06
D837,065 S * 1/2019 Baez ..... D9/702
11,203,474 B2 * 12/2021 Sawicki ..... B65D 67/00
2004/0026488 A1 2/2004 Beach
2009/0127322 A1 * 5/2009 Miller ..... B65D 65/22 229/87.19
2012/0012646 A1 * 1/2012 Bissonnette ..... B65D 65/22 53/461
2016/0340074 A1 11/2016 Jackson, Jr.
2017/0259973 A1 * 9/2017 Crossno ..... B65D 65/10

* cited by examiner

*Primary Examiner* — Peter N Helvey
(74) *Attorney, Agent, or Firm* — Boudwin Intellectual Property Law, LLC; Daniel Boudwin

(57) ABSTRACT

A gift wrap system is provided. The gift wrap system includes a flexible fabric member having an interior surface opposite an exterior surface. A first plurality of fasteners is disposed along the exterior surface, wherein the first plurality of fasteners includes a combination of male fasteners and female fasteners removably securable to each other. In some embodiments, at least one accessory is removably securable to one of the first plurality of fasteners via a complementary fastener.

4 Claims, 4 Drawing Sheets

GIFT WRAP SYSTEM

CROSS REFERENCE TO RELATED APPLICATIONS

This application claims the benefit of U.S. Provisional Application No. 62/930,117 filed on Nov. 4, 2019. The above identified patent application is herein incorporated by reference in its entirety to provide continuity of disclosure.

BACKGROUND OF THE INVENTION

The present invention relates to gift wrap systems. More particularly, the present invention pertains to reusable gift wrap systems having fasteners configured to secure the gift wrap system about an object.

Many individuals use gift wrapping to wrap packages before giving gifts for various events and special occasions. Gift wrapping can add an element of surprise for the recipient of the gift, such that the recipient enjoys the special occasion more than if they had received an unwrapped gift. Typical gift wrapping comprises a long roll of decorative paper that must be cut to accommodate the size of the package to be wrapped. However, many individuals struggle with the process of wrapping gifts, particularly in judging the size or amount of wrapping paper needed to fully encase the gift. Failing to properly portion gift wrapping can result in wasted paper that must be thrown out. Over time, this waste can add up, leading to undue expense.

Furthermore, many individuals struggle to properly wrap the package, as typical wrapping paper can easily tear if mishandled. In this manner, the gift giver must take care during transport to ensure the wrapping is not torn. Additionally, producing an aesthetically pleasing wrapped gift can be difficult, as even carefully wrapped gifts may not have creasing that perfectly conforms to the gift. Several disposable accessories may be additionally applied to the package to add visual appeal or properly address the package to a particular recipient, such as bows, tags, and the like. These accessories, once applied, often cannot be used with additional packages. Therefore, a gift-wrapping system that can be reused while also being easily and efficiently applied to a desired package is desired.

In light of the devices disclosed in the known art, it is submitted that the present invention substantially diverges in design elements from the known art and consequently it is clear that there is a need in the art for an improvement to existing gift wrap systems. In this regard, the instant invention substantially fulfills these needs.

SUMMARY OF THE INVENTION

In view of the foregoing disadvantages inherent in the known types of gift wrap systems now present in the known art, the present invention provides a gift wrap system wherein the same can be utilized for providing convenience for the user when wrapping gifts efficiently while preserving the gift wrap for reuse.

The present system comprises a flexible fabric member having an interior surface opposite an exterior surface. A first plurality of fasteners is disposed along the exterior surface, wherein the first plurality of fasteners comprises a combination of male fasteners and female fasteners configured to removably secure to each other. In some embodiments, at least one accessory is removably securable to the first plurality of fasteners via a complementary fastener disposed thereon. The at least one accessory comprises an item selected from a group consisting of a gift tag, a writing implement, a bow, and a decorative button.

In some embodiments, the first plurality of fasteners is disposed about a perimeter of the flexible fabric member. In another embodiment, the first plurality of fasteners is disposed along an entirety of the exterior surface in a series of parallel rows and columns. In other embodiments, the first plurality of fasteners is disposed along an entirety of the exterior surface in a series of offset rows and columns. In yet another embodiment, the first plurality of fasteners is disposed in an alternating pattern between male fasteners and female fasteners, such that each male fastener is adjacent to at least one female fastener. In some embodiments, a second plurality of fasteners is disposed about a perimeter of the interior surface. In another embodiment, the second plurality of fasteners comprise male fasteners and female fasteners disposed in an alternating pattern, such that each male fastener is adjacent to at least one female fastener. In other embodiments, the second plurality of fasteners is disposed in a pattern mirroring the pattern of the first plurality of fasteners. In yet another embodiment, the flexible fabric member comprises an elastic material. In some embodiments, a first indicia is disposed on the interior surface and a second indicia is disposed on the exterior surface, wherein the first indicia is distinct from the second indicia.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
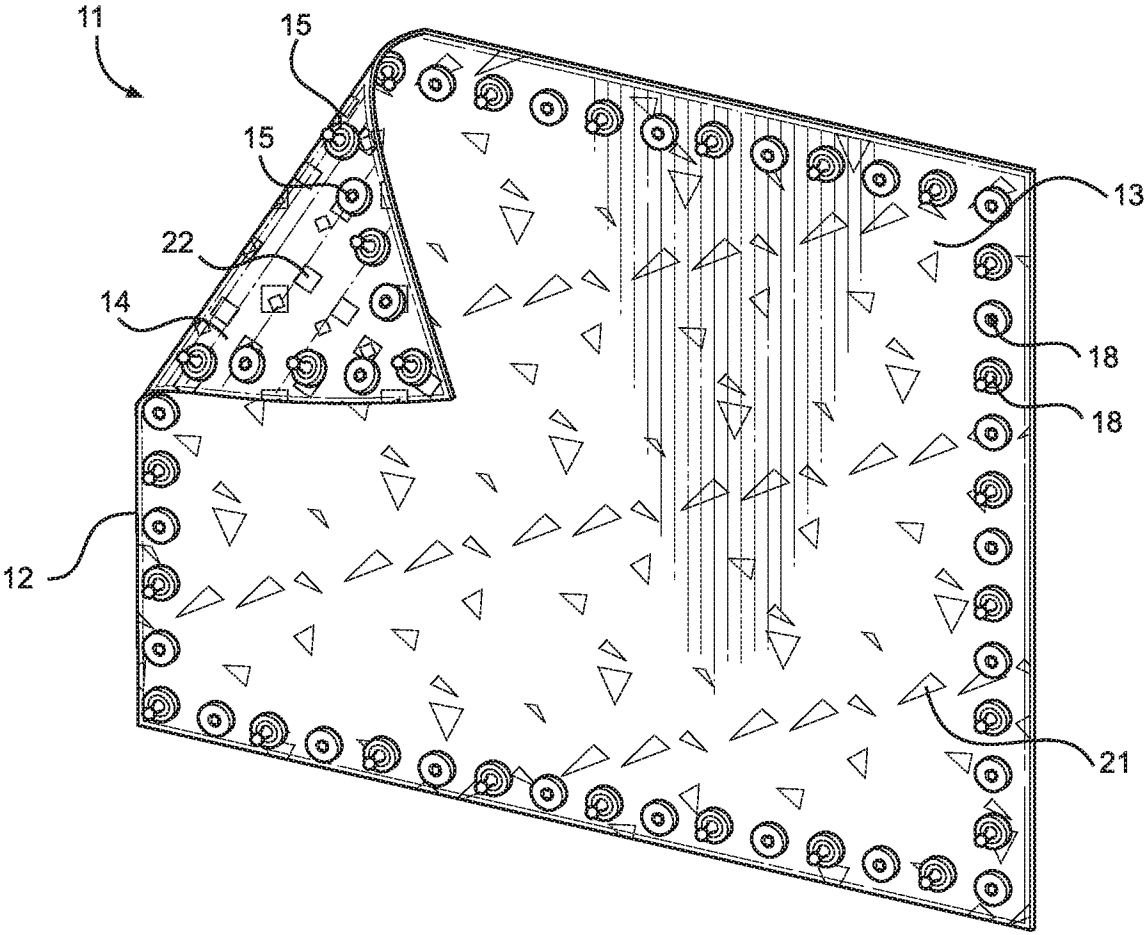
FIG. 1 shows a perspective view of an embodiment of the gift wrap system.

Reference is made herein to the attached drawings. Like reference numerals are used throughout the drawings to depict like or similar elements of the gift wrap system. The figures are intended for representative purposes only and should not be considered to be limiting in any respect.

Referring now to FIG. 1, there is shown a perspective view of an embodiment of the gift wrap system. The gift wrap system 11 comprises a flexible member 12 having an interior surface 13 opposite an exterior surface 14. The flexible member 12 is further contemplated to comprise a fabric material, such that the flexible member 12 can be reused to minimize waste. As such, the flexible member 12 is contemplated to comprise any number of various fabrics or other flexible materials commensurate with strength and durability. In some embodiments, the flexible member 12 comprises an elastic material, such that the flexible member 12 can stretch around and conform to a wide variety of objects, gifts, packages, and the like. In the illustrated embodiment, the interior surface 13 comprises a first indicia 21 thereon, whereas the exterior surface 14 comprises a second indicia 22 thereon. In such embodiments, the first and second indicia 21, 22 comprise different patterns or designs, allowing the flexible member 12 to be applied to an object reversibly, thereby allowing a user to select a desired appearance for the wrapped item. In the illustrated embodiment, the flexible member 12 comprises a rectangular shape, however, in alternate embodiments, various shapes are contemplated to allow the gift wrap system 11 to be easily utilized with various items. For example, in alternate embodiments, the perimeter of the flexible member 12 can taper from one end to another to conform to the dimensions of a bottle or other item.

A first plurality of fasteners 15 is disposed on the exterior surface 14, wherein the first plurality of fasteners 15 comprise a combination of male and female fasteners. In this manner, the first plurality of fasteners 15 can removably secure to each other about an object to be wrapped. In the illustrated embodiment, the first plurality of fasteners 15 extend along a perimeter of the flexible member 12, however, in alternate embodiments elsewhere described herein, the first plurality of fasteners 15 is distributed across an entirety of the exterior surface 14. In the illustrated embodiment, the first plurality of fasteners 15 comprises an alternating pattern of male and female fasteners, such that each male fastener of the first plurality of fasteners 15 is adjacent to a female fastener of the first plurality of fasteners 15. In this manner, the user can fold the flexible member 12 about a gift and secure opposing ends of the exterior surface 14 together via the first plurality of fasteners 15 to secure the flexible member 12 about the gift.

Similarly, in the shown embodiment, the gift wrap system 11 further comprises a second plurality of fasteners 18 disposed on the interior surface 13. The second plurality of fasteners 18 additionally comprises a combination of male and female fasteners. In the shown embodiment, the second plurality of fasteners 18 comprises an alternating pattern of male and female fasteners disposed about a perimeter of the flexible member 12. In this manner, as the flexible member 12 is folded about a gift, the first plurality of fasteners 15 can removably secure to the second plurality of fasteners 18 to secure the flexible member 12 about the gift. In some embodiments, the first and second plurality of fasteners 15, 18 are mirrored relative to each other about the plane of the flexible member 12, such that a male fastener of the first plurality of fasteners 15 is disposed directly opposite a male fastener of the second plurality of fasteners 18. Alternatively, the first and second plurality of fasteners 15, 18 may be disposed across the interior and exterior surfaces 13, 14 such that a male fastener of the first plurality of fasteners 15 is directly opposite a female fastener of the second plurality of fasteners 18. In this manner, the user can removably secure the first and second plurality of fasteners 15, 18 together about a gift. In the shown embodiment, the first and second plurality of fasteners 15, 18 comprise low-profile snap fasteners allowing the gift wrap system 11 to secure about an object while minimally protruding therefrom. In alternate embodiments, alternate forms of fasteners are contemplated, such as, but not limited to, hook and loop, buttons, clasps, and the like.

Figure 2B:
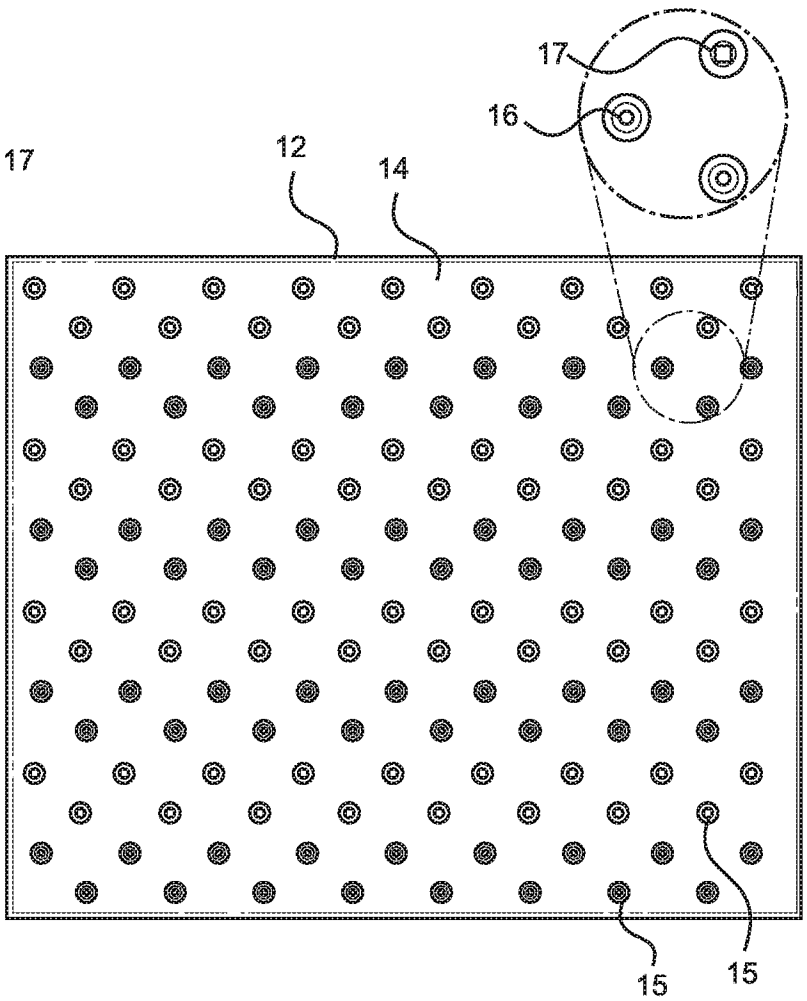
FIG. 2B shows a front view of an alternate embodiment of the gift wrap system.
Figure 2A:
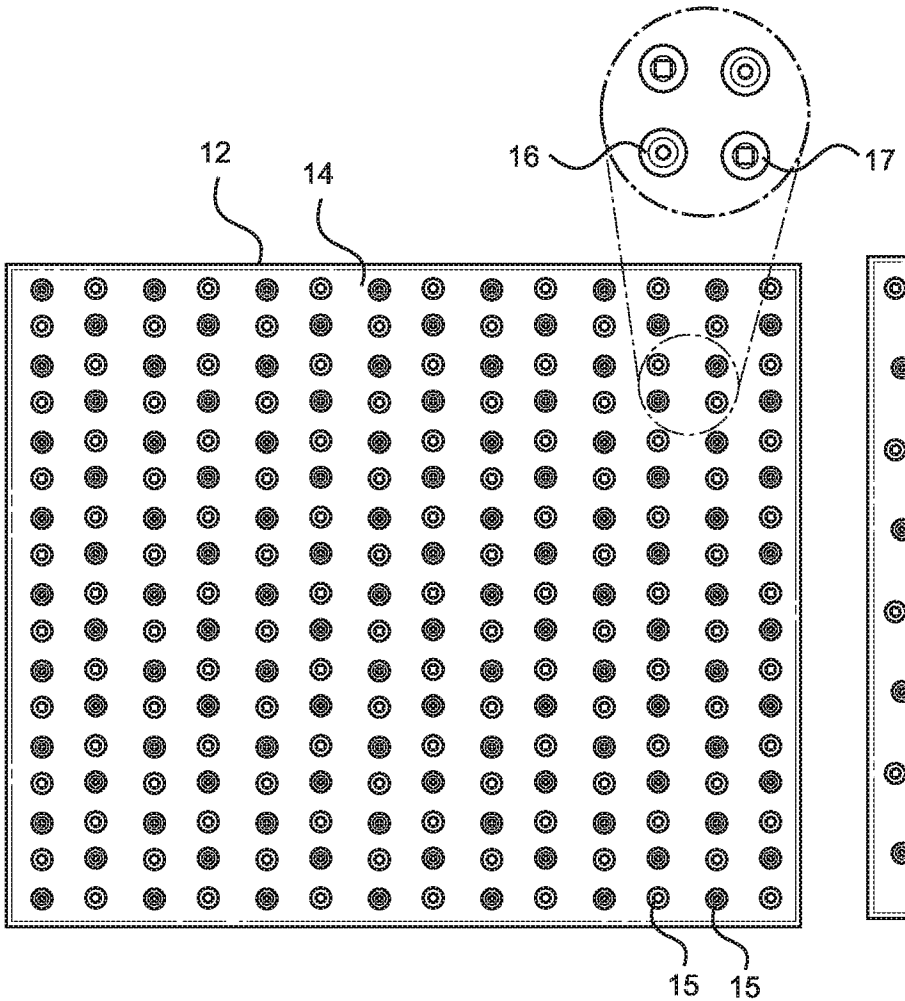
FIG. 2A shows a front view of an embodiment of the gift wrap system.

Referring now to FIGS. 2A and 2B, there is shown a front view of an embodiment of the gift wrap system and a front view of an alternate embodiment of the gift wrap system, respectively. In the illustrated embodiments, the first plurality of fasteners 15 are disposed across an entirety of the exterior surface 14 of the flexible member 12 in various patterns. As described above, the second plurality of fasteners are contemplated to be disposed across the interior surface in a similar pattern. In the illustrated embodiment of FIG. 2A, the first plurality of fasteners 15 is disposed across the exterior surface 14 in a plurality of parallel rows and columns. This arrangement provides advantages when wrapping items of regular dimensions with sharp edges, as the flexible member 12 can be folded along a linear pathway between one of the rows or columns of the first plurality of fasteners 15 to define a sharp edge. In embodiments in which the flexible member 12 is elastic, the distance between adjacent rows and columns can be selectively increased via application of force to allow the flexible member 12 to surround an item of larger dimensions. Similarly, the elastic nature allows the user to adjust the position of each fastener relative to another to aid in securing the flexible member 12 about the item. In the shown embodiment, the first plurality of fasteners 15 are disposed across the exterior surface in an alternating pattern, such that each male fastener 17 is disposed adjacent to at least one female fastener 16.

In the shown embodiment of FIG. 2B, the first plurality of fasteners 15 is disposed across the exterior surface 14 in a plurality of offset rows and columns. Utilizing this distribution, the flexible member 12 is more readily capable of securing about objects of less regular shape, such as rounded, bulbous, or particularly varied exterior shapes as each fastener of the first plurality of fasteners 15 is spaced farther apart than in the embodiment of FIG. 2A, providing the flexible member 12 with greater flexibility. Similar to the above described embodiment, the first plurality of fasteners 15 are disposed in an alternating pattern, such that a male fastener 17 is adjacent to at least one female fastener 16, ensuring that an opposing fastener is within close proximity when the flexible member 12 is wrapped about a gift.

Figure 3:
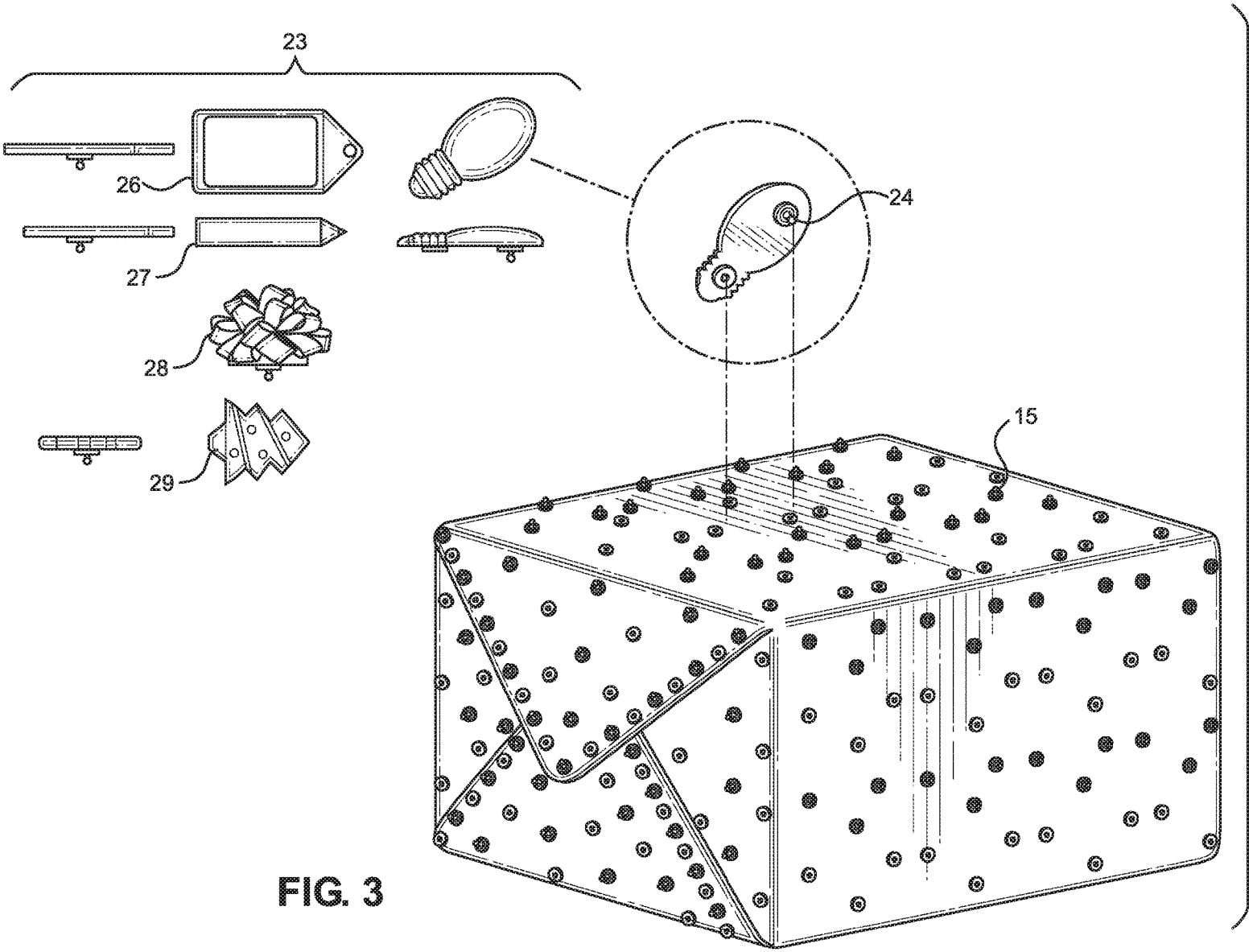
FIG. 3 shows a perspective view of the plurality of accessories of an embodiment of the gift wrap system.

Referring now to FIG. 3, there is shown a perspective view of the plurality of accessories of an embodiment of the gift wrap system. In the illustrated embodiment, at least one accessory 23 includes a complementary fastener 24 thereon, wherein the complementary fastener 24 is configured to removably secure to one or more of the first plurality of fasteners 15. In this manner, the gift wrapped in the gift wrap system can be decorated or addressed to a particular recipient with one or more reusable or removable accessories 23. In the shown embodiment, the accessories 23 are selected from a group consisting of a gift tag 26, a writing implement 27, a bow 28, and a decorative button 29. The gift tag 26 is contemplated to be usable with either a traditional pen or marker, or alternatively with a removable marking implement, such as a chalk pen. With the use of a chalk pen, the gift tag 26 can be erased and reused for a different gift after the initial gift is unwrapped. In such embodiments, the writing implement 27 can comprise a traditional permanent marking device, such as a pen or marker, or a chalk pen to correspond to the type of gift tag 26 in use. The decorative button 29 can comprise any number of different designs to suit a particular holiday or gift giving event. For example, in the shown embodiment, the decorative buttons 29 comprise Christmas trees and lights to allow a user to decorate the gift with Christmas themed decorative buttons 29. However, alternate formats of decorative buttons 29 more suitable for birthdays or other gift giving holidays are contemplated. In some embodiments, the accessory 23 comprises more than one complementary fastener 24 thereon, such that the accessory 23 can be stably secured to the gift via the first plurality of fasteners 15.

Figure 4:
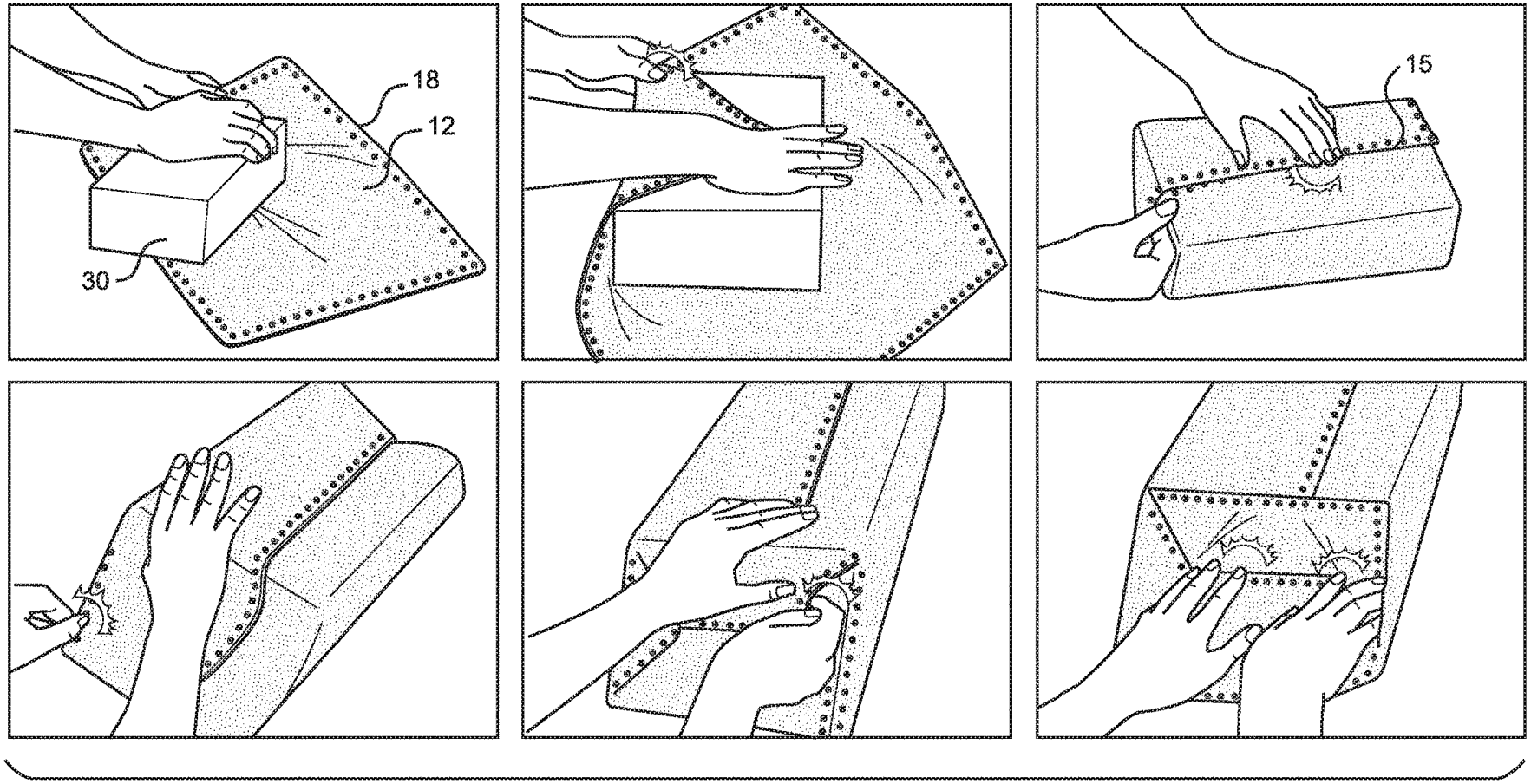
FIG. 4 shows a series of perspective views of an embodiment of the gift wrap system in use.

Referring now to FIG. 4, there is shown a series of perspective views of an embodiment of the gift wrap system in use. In one use, the user places the flexible member 12 on a flat surface such that the interior surface is exposed. A package 30 that the user wishes to wrap with the gift wrap system is then placed on the flexible member 12. In the case that the package 30 is too large to wrap with a single flexible member 12, multiple flexible members 12 can be secured together via securing the first plurality of fasteners 15 on the exterior surface of the flexible member 12 to the second plurality of fasteners 18 on the interior surface of an adjacent flexible member 12. In this way, the user can secure multiple flexible members 12 together along at least the perimeters thereof to create an assembly having a surface area large enough to fully encompass a package 30. The flexible member 12 can then be folded over the package 30 similar to how a traditional gift-wrapping process occurs. The user can then selectively secure the first and second plurality of fasteners 15, 18 to each other where the flexible member 12 overlaps during the wrapping process to secure the flexible member 12 about the package. Should the fasteners not properly overlap due to the contours of the package 30, elastic embodiments of the gift-wrapping system can be stretched to ensure a fastener can engage an opposing fastener. In this manner, the user can wrap a gift in a reusable wrapping, thereby minimizing waste incurred during a typical gift-wrapping experience.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gift wrap system, comprising:

a flexible fabric member having an interior surface opposite an exterior surface; and a first plurality of fasteners disposed along the exterior surface;

wherein the first plurality of fasteners comprises a combination of a first plurality of male fasteners and a first plurality of female fasteners configured to removably secure to each other; and wherein the first plurality of fasteners is disposed about a perimeter of the flexible fabric member;

further comprising a second plurality of fasteners disposed about a perimeter of the interior surface; and wherein a first indicia is disposed on the interior surface and a second indicia is disposed on the exterior surface, wherein the first indicia is distinct from the second indicia.

2. The gift wrap system of claim 1, wherein the first plurality of fasteners is disposed in an alternating pattern between the first plurality of male fasteners and the first plurality of female fasteners, such that each first male fastener is adjacent to at least one first female fastener.

3. The gift wrap system of claim 1, wherein the second plurality of fasteners comprise a second plurality of male fasteners and a second plurality of female fasteners disposed in an alternating pattern, such that each second male fastener is adjacent to at least one second female fastener.

4. The gift wrap system of claim 1, wherein the flexible fabric member comprises an elastic material.

* * * * *